US006244051B1

(12) United States Patent
Zarzalis et al.

(10) Patent No.: US 6,244,051 B1
(45) Date of Patent: Jun. 12, 2001

(54) BURNER WITH ATOMIZER NOZZLE

(76) Inventors: Nikolaos Zarzalis, Krankenhausstrasse 23a, D-85221 Dachau (DE); Thomas Ripplinger, Samfeldstrasse 1, D-85256 Vlerkirchen (DE); Bernhard Glaeber, Bodenseestrasse 50, D-82194 Gröbenzell (DE); Burkhard Simon, Plattenfeld 5, D-85244 Röhrmoos (DE)

( * ) Notice: Subject to any disclaimer, the term of this patent is extended or adjusted under 35 U.S.C. 154(b) by 0 days.

(21) Appl. No.: 09/214,833

(22) PCT Filed: Jul. 8, 1997

(86) PCT No.: PCT/EP97/03595

§ 371 Date: Jan. 11, 1999

§ 102(e) Date: Jan. 11, 1999

(87) PCT Pub. No.: WO98/01706

PCT Pub. Date: Jan. 15, 1998

(30) Foreign Application Priority Data

Jul. 10, 1996 (DE) ..... 196 27 760

(51) Int. Cl.[7] ..... F02C 3/00
(52) U.S. Cl. ..... 60/743; 60/748
(58) Field of Search ..... 60/748, 737, 743

(56) References Cited

U.S. PATENT DOCUMENTS 5,285,631 2/1994 Bechtel, II et al. .
5,373,693 * 12/1994 Zarzalis et al. ..... 60/748 X
5,623,827 * 4/1997 Monty ..... 60/748
5,647,538 * 7/1997 Richardson ..... 239/405
5,765,376 * 6/1998 Zarzalis et al. ..... 60/748
5,836,163 * 11/1998 Lockyear et al. ..... 60/737

FOREIGN PATENT DOCUMENTS 1099959 1/1968 (GB) .
2 094 464 9/1982 (GB) .
2 272 756 5/1994 (GB) .

* cited by examiner

*Primary Examiner*—Charles G. Freay
*Assistant Examiner*—David J. Torrente
(74) *Attorney, Agent, or Firm*—Schiff Hardin & Waite

(57) ABSTRACT

The invention relates to a burner for combustors of gas turbines, the burner having an atomizer nozzle for atomisation of fuel in the combustion air and having a primary and secondary flow channel. In the burners, mostly used in aircraft engines, an extensively homogenous distribution of the air-fuel mixture is to be achieved in the combustor to reduce emissions. The flow channels opening into the combustor are separated from a first component arranged concentrically in relation to the burner axis and having a sleeve-shaped atomizer lip extending cylindrically or conically, and the external secondary flow channel is bounded externally and radially by a second annular component arranged concentrically and having an internal wall extending to converge and diverge. The second component forms an area with the most narrow flow cross-section, and the first component is arranged radially inwards and ends with the atomizer lip at the axial height of the cross-section or upstream thereof. The air flow flows through the flow channels to twist in the same direction. By positioning the atomizer lip at the narrowest flow cross-section in the or just in front of the atomizer nozzle, the fuel can be atomized in a range of the maximum air shear forces with the result that there can be optimal atomization.

6 Claims, 2 Drawing Sheets

BURNER WITH ATOMIZER NOZZLE

FIELD OF THE INVENTION

The present invention generally relates to burners for combustion chambers of gas turbines.

BACKGROUND OF THE INVENTION

One example of a gas turbine burner is disclosed by German Patent Application P 44 44 961.

Accordingly, there are needs for reduction of pollutants that arise when burning kerosene in combustion chambers of aircraft engines is a constant development goal. The pollutant-reduced combustion chambers. Components of the combustion chamber must be optimized for realizing the pollutant-reduced combustion concepts. Thus, for example, it is important to atomize the fuel as finely as possible in all operating ranges and blend it with the combustion air. This fuel processing is accomplished with air atomizer nozzles in combustion chambers of modern aircraft gas turbines. According to their function principle, the fuel flows on a cylindrical surface to the end thereof, where the atomization begins due to the air shearing forces. In order to avoid undesired enrichments of fuel in the combustion space of the combustion chamber that can lead to soot, the air stream through the atomizer nozzle is divided into a primary and secondary flow channels and oppositely twisted, so that oppositely directed rotation eddies are generated in the combustion space. To this end, a twist mechanism radially impacted by the flow is allocated to each flow channel. A high twist factor of the air stream also leads to a recirculation turbulence at the back wall of the combustion space, which is intended to achieve a homogeneous burning. In order to avoid a premature blending of the two air streams, which would in turn lead to a reduction of the circumferential velocity in the secondary air stream, the atomizer lip that separates the primary from the secondary air stream is implemented optimally long, up to the discharge of the atomizer nozzle at the side of the combustion space. With such atomizer nozzles and convergent-divergently implemented flow channels, however, the atomization does not take place Furthermore, the mass stream of the secondary air stream must be greater than that of the primary air stream, so that the circumferential impulse of the secondary air stream is not completely dismantled in the short distance from the end of the atomizer lip up to the entry into the combustion space and the creation of the recirculation turbulence is jeopardized. However, not that the distribution of the air-fuel relationship at the nozzle discharge does not exhibit the desired homogeneity because the primary air stream, which mainly participates in the mixing process, is less than the secondary air stream.

SUMMARY OF THE INVENTION

GB 2 272 756 A discloses an injection device for a combustion chamber that comprises an atomizer, a plurality of channels and a pre-mixing path, whereby the fuel is first atomized at baffled elements with atomizer lips surrounding the channels and is subsequently mixed in the pre-mixing path is with the air streams form the channels that discharge into pre-mixing path. The pre-mixing path is convergent-divergently fashioned in order to assure a good mixing of the atomized fuel with the air streams.

GB 1 099 959 and GB 2 094 464 A discloses a burner for solid or liquid fuels, whereby the fuel is mixed with a plurality of air streams and, whose channels are formed by concentrically arranged pipes with divergent discharge nozzles. Upon utilization of liquid fuels, this is atomized in an atomizer means at the point of entry into the nozzle space.

The present invention provides a burner that enables a far-reaching homogeneous distribution of the air-fuel mixture in the combustion space.

The present invention pertains to burners for combustion chambers of gas turbines. The burner has an atomizer nozzle for atomizing fuel in the combustion air that flows through a primary and secondary flow channel upstream of the combustion space of the combustion chamber. The flow channels discharge into the combustion space and are separated by a first component part that is concentrically arranged with respect to a burner access and has a sleeve-shaped atomizer lip that proceeds cylindrically or conically tapering. The outer, secondary flow channel is radially outwardly limited by a concentrically arranged, annular second component part with a convergent-divergently proceeding inside wall. The second component part forms a location of a narrowest flow cross-section at an axial height or upstream therefrom the radially inwardly arranged, first component part with the atomizer lip ends. An air stream flows through the flow channels with an isodirectional twist.

The invention has the advantage that, due to the isodirectional twist of the two air streams and, a mixing thereof before entry into the combustion space a high circumferential velocity can be maintained and the mass stream relationship can also be selected independently of the twist of the streams in order to be able to homogeneously fashion the distribution of the air-fuel mixture. The twist factor of the air stream can also be varied disregarding a mixing of the two streams in order to set a detached or a wall-adjacent flow condition in the combustion space. As a result of positioning the atomizer lip at the narrowest flow crossection in the atomizer nozzle or shortly therebefore, the atomization of the fuel can ensue in an area of the maximum air shearing forces, so that the atomization can ensue optimally.

BRIEF DESCRIPTION OF THE DRAWINGS

A preferred embodiment of the invention is explained below with reference to the attached drawings.

DESCRIPTION OF PRESENTLY PREFERRED EMBODIMENTS

Although the present invention can be made in many different forms, the presently preferred embodiments are described in this disclosure and shown in the attached drawings. This disclosure exemplifies the principles of the present invention and does not limit the broad aspects of the invention only to the illustrated embodiments.

Figure 1:
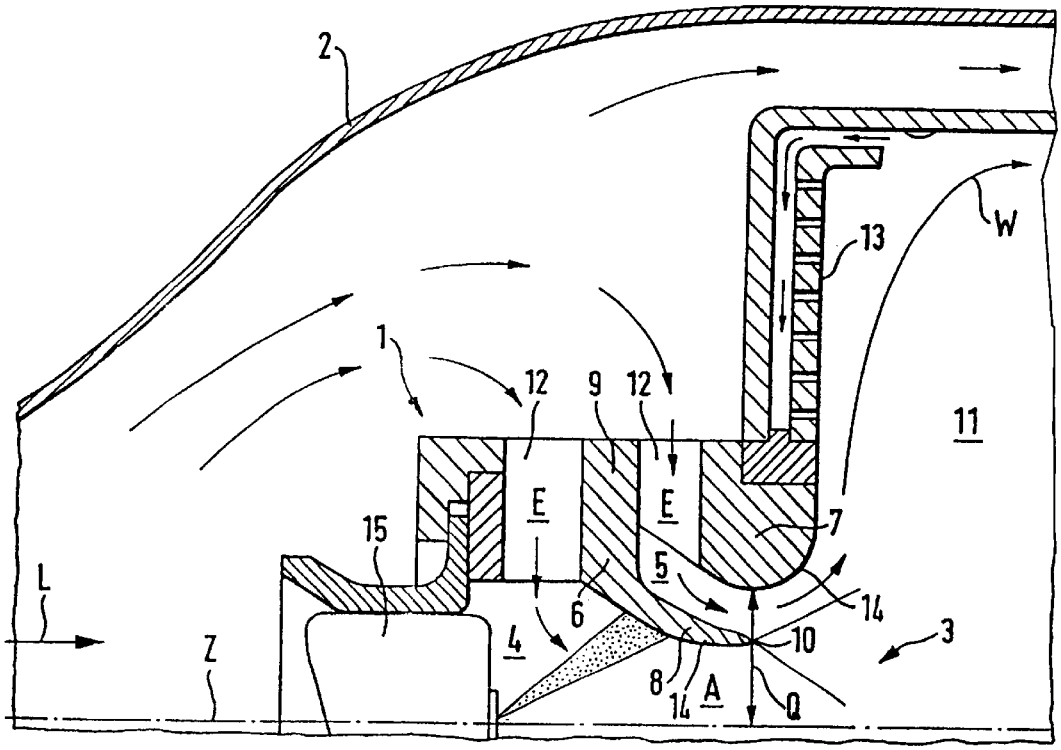
FIG. 1 is a partial, section view of a front combustion chamber section with a burner.

The burner 1 shown in FIG. 1 is one of a plurality of annularly arranged burners of the sectionally shown combustion chamber 2 of an aircraft gas turbine.

The burner 1 comprises an atomizer nozzle 3 with a primary flow channel 4 and a secondary flow channel 5 as well as injection nozzle 15. The two flow channels 4, 5 have their channel course defined and limited by annular or sleeve-shaped component parts 6, 7. The two flow channels 4, 5 are conducted concentrically to a burner axis Z and comprise a radially proceeding entry section E, which receives an air stream L in order to then be deflected into an essentially axially proceeding exit section A. The sleeve-shaped component part 6 separates the two channels 4, 5 from one another and its downstream section comprises an annular atomizer lip 8 with conically tapering course. At its upstream section, the component part 6 comprises a radially extending flange 9 that separates the two axially spaced, annular entry sections E of the channels 4, 5 from one another. The secondary flow channel 5 proceeding between the two component parts 6 and 7 has its radially extending entry section E limited by two annular wall sections of the two component parts 6 and 7, in which the annular wall sections proceed parallel to one another. In the exit section A, the secondary flow channel 5 is radially outwardly limited by an inside wall 14 of the component part 7 that proceeds convergent-divergently as viewed in flow direction. The atomizer lip 8 ends immediately before the location with the narrowest flow crossection Q, which is defined by the convergent-divergent course of the component part 7, so that a homogeneous mixing of the two air streams ensues downstream of the atomizer lip 8, within the divergent section of the component part 7 and downstream therefrom.

Finely atomized fuel in the form of a cone expanding fan-like is sprayed onto the conically tapering inside wall 14 of the atomizer lip 8 with the injection nozzle 15 arranged in the primary flow channel 4, so that this fuel deposits film-like on the inside wall. The fuel film tears off in the course of an occurring shearing stream at the downstream, sharp-edged end edge 10 of the atomizer lip 8, so that the fuel is introduced fog-like and partly vaporized as well as uniformly distributed into the rotation eddy W forming in the combustion space 11 of the combustion chamber 2.

The two flow channels 4, 5 are dimensioned such in terms of crossection that a mass flow ratio of greater than 0.4 derives between primary 15 and secondary air streams. A homogeneous mixing in of the combustion space of the air-fuel mixture is assured as a result thereof. Twist devices 12 are arranged in each of the flow channels 4, 5 before the exit section A from the flow channels 4, 5.

Figure 2A:
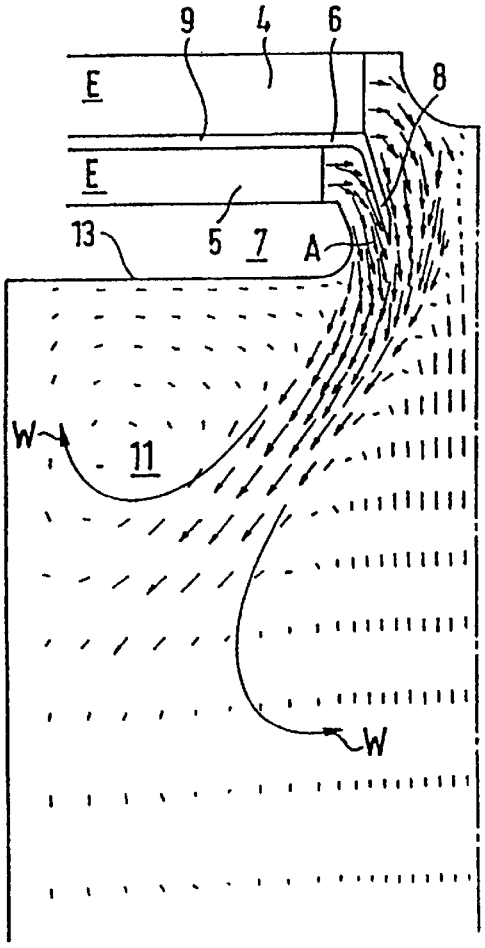
FIG. 2*a* is a partial, sectional view showing the flow condition in the combustion chamber and in the atomizer nozzle with detached flow.
Figure 2B:
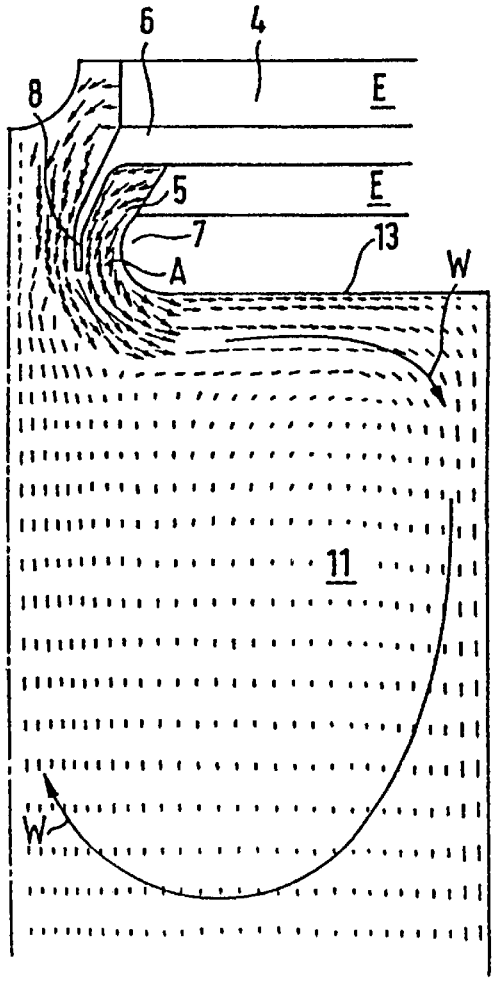
FIG. 2*b* is a partial, sectional view showing the flow condition in the combustion chamber and in the atomizer nozzle with wall-adjacent flow.

As can be seen in FIGS. 2*a* and 2*b*, a detached or, wall-adjacent combustion space flow can be presented by the isodirectional twist formation in the flow channels 4 and 5 by varying the twist factor in the two channels 4, 5, so that the position and creation of the rotation eddy W can be influenced. Given the wall-adjacent flow according to FIG. 2*b*, the air stream discharges into the combustion space downstream of the divergent section of the component part 7 and flows off parallel to the radially proceeding back wall 13 of the combustion space 11, in order to then flow centrally in the direction of the burner 1 in a recirculation eddy W approximately parallel to the burner axis Z.

Two recirculation eddies W, by contrast, can be seen given the flow shown in FIG. 2*a*, whereby the eddy W forms in the region of the back wall 13 and the other forms with an opposite twist direction in the central region of the combustion space 11.

While the presently preferred embodiments have been illustrated and described, numerous changes in modifications can be made without 15 significantly departing from the spirit and scope of this invention.

Therefore, the inventors intend that such changes and modifications are covered by the appended claims. The two component parts of the burner may be concentrically arranged with respect to the burner access and form the annular, secondary flow channel between them. The flow channels may have twist devices respectively arranged before their exit sections. The mass flow ratio of the primary and secondary air stream is greater than 0.4. The burner may have an injection nozzle through which fuel is injected into the primary flow channel onto an inside wall of the first component part upstream of the atomizer lip.

What is claimed is:

1. A burner for combustion chambers, having a combustion space, of gas turbines comprising:

an atomizer nozzle which atomizes fuel in combustion air that flows through primary and secondary flow channels upstream of the combustion space of the combustion chamber, the fuel being sprayed onto a wall in the atomizer nozzle;

the flow channels being arranged to discharge into the combustion space and separated by a first component part that is concentrically arranged with respect to a burner axis and has a sleeve-shaped, tapered atomizer lip arranged radially inward from the first component part;

the outer, secondary flow channel being radially outwardly limited by a concentrically arranged, annular second component part with a convergent-divergently proceeding inside wall;

the primary and secondary channels being configured such that a mass flow ratio of a primary air stream through the primary flow channel to a secondary air stream through the secondary flow channel is greater than 0.4, and the secondary mass flow is greater than the primary mass flow; and said second component part forming a location in the atomizer nozzle having a narrowest flow cross-section, the atomizer lip ending at least as far axially downstream as the location having the narrowest flow cross-section, and the flow channels providing an air stream flow through the flow channels with an isodirectional twist.

2. A burner according to claim 1, wherein the two component parts are concentrically arranged with respect to the burner axis and form the annular, secondary flow channel between them.

3. A burner according to claim 1, further comprising a twist device arranged in each of the flow channels before an exit section in each of the flow channels.

4. A burner according to one of the preceding claims, further comprising an injection nozzle via which fuel is injected into the primary flow channel onto an inside wall of the first component part upstream of the atomizer lip.

5. A burner according to claim 2, further comprising a twist device arranged in each of the flow channels before an exit section in each of the flow channels.

6. A burner according to claim 1, further comprising an injection nozzle through which fuel is injected into the primary flow channel onto an inside wall of the first component part upstream of the atomizer lip.

* * * * *